US006507329B2

(12) United States Patent
Cathey, Jr. et al.

(10) Patent No.: US 6,507,329 B2
(45) **Date of Patent: *Jan. 14, 2003**

(54) LIGHT-INSENSITIVE RESISTOR FOR CURRENT-LIMITING OF FIELD EMISSION DISPLAYS

(75) Inventors: David A. Cathey, Jr., Boise, ID (US); Kevin W. Tjaden, Boise, ID (US); Behnam Moradi, Boise, ID (US); John K. Lee, Meridian, ID (US); James J. Alwan, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/774,812

(22) Filed: Jan. 30, 2001

(65) Prior Publication Data

US 2001/0011977 A1 Aug. 9, 2001

Related U.S. Application Data

(63) Continuation of application No. 08/701,306, filed on Aug. 21, 1996, now Pat. No. 6,181,308, which is a continuation-in-part of application No. 08/543,435, filed on Oct. 16, 1995, now abandoned.

(51) Int. Cl.[7] ..... G09G 3/22
(52) U.S. Cl. ..... 345/75.2; 315/169.3
(58) Field of Search ..... 345/74, 75, 76, 345/79, 75.2; 313/309, 310, 307, 306, 311, 354, 495, 336; 315/169.3, 169.1, 169.4; 257/99; 438/20; 349/69, 144

(56) References Cited

U.S. PATENT DOCUMENTS

| | | | | |
|---|---|---|---|---|
| 3,814,968 A | | 6/1974 | Nathanson et al. | 313/95 |
| 3,833,894 A | * | 9/1974 | Aviram et al. | |
| 4,842,372 A | * | 6/1989 | Toyama | |
| 4,940,916 A | | 7/1990 | Borel et al. | 313/306 |
| 5,396,150 A | | 3/1995 | Wu et al. | 313/495 |
| 5,532,177 A | | 7/1996 | Cathey | 437/40 |
| 5,572,041 A | | 11/1996 | Betsui et al. | 257/10 |
| 5,585,301 A | | 12/1996 | Lee et al. | 437/60 |
| 5,618,403 A | * | 4/1997 | de Nora | |

(List continued on next page.)

FOREIGN PATENT DOCUMENTS

| | | |
|---|---|---|
| EP | 0 757 341 | 2/1997 |
| WO | WO 95/07543 | 3/1995 |

OTHER PUBLICATIONS

McGruer, Nicol, "NU/Micron R.I.S. F.E.A. Project," *First Quarterly Report*, Department of Electrical and Computer Engineering, Northeastern University, Boston, MA 02115, Oct. 15, 1996.

Madan, Arun, and Melvin P. Shaw, *The Physics and Applications of Amorphous Semiconductors*, Academic Press, Inc., California, 1988, pp. 97–106, 117–125.

Lee, Kon Juin, "current Limiting of Field Emitter Array Cathodes," thesis, Georgia Institute of Technology, 1986, pp. iii–xii, 1–165, 185–188.

Shigeo Itoh et al., "A New Structure of Field Emitter Arrays", *Journal of Vacuum Science and Technology* B 14(3):1977–1981, 1996.

*Primary Examiner*—Chanh Nguyen
(74) *Attorney, Agent, or Firm*—Dorsey & Whitney LLP

(57) ABSTRACT

A semiconductor device for use in field emission displays includes a substrate formed from a semiconductor material, glass, soda lime, or plastic. A first layer of a conductive material is formed on the substrate. A second layer of microcrystalline silicon is formed on the first layer. This layer has characteristics that do not fluctuate in response to conditions that vary during the operation of the field emission display, particularly the varying light intensity from the emitted electrons or from the ambient. One or more cold-cathode emitters are formed on the second layer.

13 Claims, 4 Drawing Sheets

U.S. PATENT DOCUMENTS 5,619,097 A 4/1997 Jones ..... 313/495
5,656,886 A 8/1997 Westphal et al. ..... 313/495
5,696,389 A 12/1997 Ishikawa et al. ..... 257/99
5,729,094 A 3/1998 Geis et al. ..... 315/169
5,734,361 A 3/1998 Suzuki et al. ..... 345/74
5,747,918 A 5/1998 Eom et al. ..... 313/309
5,760,536 A 6/1998 Susukida et al. ..... 313/311
6,031,250 A * 2/2000 Brandes et al.

* cited by examiner

LIGHT-INSENSITIVE RESISTOR FOR CURRENT-LIMITING OF FIELD EMISSION DISPLAYS

CROSS-REFERENCE TO RELATED APPLICATION

This application is a continuation of U.S. patent application Ser. No. 08/701,306, filed Aug. 21, 1996, and issued as U.S. Pat. No. 6,181,308 B1 on Jan. 30, 2001, which is a continuation-in-part of U.S. patent application Ser. No. 08/543,435, filed Oct. 16, 1995, now abandoned.

TECHNICAL FIELD

The present invention relates generally to field emission devices, and more particularly, to field emission displays having current-limiting resistors.

BACKGROUND OF THE INVENTION

A typical field emission display 8 is shown in FIG. 1. The display 8 includes a substrate or base plate 10 having a conductive layer 12 formed thereon. A plurality of emitters 14 are formed on the layer 12. Also formed on the layer 12 is an electrically insulating layer 16 having a conductive layer formed thereon. The conductive layer formed on the insulating layer 16 typically functions as an extraction grid 18 to control the emission of electrons from the emitters 14, and is typically formed from metal. An anode 20, which acts as a display screen and has a cathodoluminescent coating 22 formed on an inner surface thereof, is positioned a predetermined distance from the emitters 14. Typically, a vacuum exists between the emitters 14 and the anode 20. A power source 24 generates a voltage differential between the anode 20 and the substrate 10, which acts as a cathode. Also, a voltage applied to the extraction grid 18 generates an electric field between the grid and the substrate 10. An electrical path is provided to the emitters 14 via the conductive layer 12 such that in response to this electric field, the emitters 14 emit electrons. The emitted electrons strike the cathodoluminescent coating 22, Which emit light to form a video image on the display screen. Examples of such field emission displays are disclosed in the following U.S. patents, all of which are incorporated by reference:

| Pat. No. | Issue Date |
|---|---|
| 3,671,798 | June 20, 1972 |
| 3,970,887 | July 20, 1976 |
| 4,940,916 | July 10, 1990 |
| 5,151,061 | Sept. 29, 1992 |
| 5,162,704 | Nov. 10, 1992 |
| 5,212,426 | May 18, 1993 |
| 5,283,500 | Feb. 1, 1994 |
| 5,359,256 | Oct. 25, 1994 |

Field emission displays, such as the field emission display 8 of FIG. 1, often suffer from technical difficulties relating to the control of the current flowing through the emitters 14. For example, due to the relatively small dimensions of the components involved, manufacturing defects are common in which an emitter 14 is shorted to the extraction grid 18. Because the voltage difference between the substrate 10 and the anode 20 is typically on the order of 1000 volts or more and a high electric field exists between tip 14 and substrate 10, the above defect can cause a current to flow through the emitter 14 that is sufficient to destroy not only the shorted emitter 14 itself, but other surrounding emitters 14 and circuitry as well. Thus, such a current draw will typically result in damage to, if not complete destruction of, the field emission display. Furthermore, if the current through the emitters 14 is unregulated, it is virtually impossible to control the emission level of the emitters 14, and thus the brightness level of the field emission display 8.

Efforts to solve the above limitations have focused on providing a resistance between the conductive layer 12 and the emitters 14 to limit the current flow through the emitters 14. An example of such a resistance is disclosed in U.S. Pat. No. 4,940,916, which was previously incorporated by reference. One limitation to this scheme, however, is that the resistivity (which is the inverse of the conductivity) of the resistive layer often fluctuates in response to conditions that vary during the operation of the field emission display, particularly the varying light intensity resulting from the emitted electrons striking the cathodoluminescent coating 22 or from ambient light.

SUMMARY OF THE INVENTION

According to one aspect of the present invention, a semiconductor structure is provided for use in a field emission display. The structure includes a substrate that may be formed from a semiconductor material, Corning glass, soda lime glass, plastic, or silicon dioxide. A first layer of a conductive material is formed on the substrate. A second layer of microcrystalline silicon is formed on the conductive layer. One or more cold-cathode emitters are formed on the second layer. The second layer forms a current-limiting resistance between the conductive layer and the emitters.

In one aspect of the invention the second layer, while exposed to optical energy, exhibits a resistivity that differs less than approximately 10% from the resistivity of the second layer while it is unexposed to optical energy, or "in the dark."

In further aspects of the invention, the second layer of microcrystalline silicon is doped with an impurity of either the p-type or the n-type.

An advantage provided by one aspect of the present invention is a current-limiting resistor that has a resistivity that remains relatively stable while the resistor is exposed to varying light intensities.

DETAILED DESCRIPTION OF THE INVENTION

Figure 1:
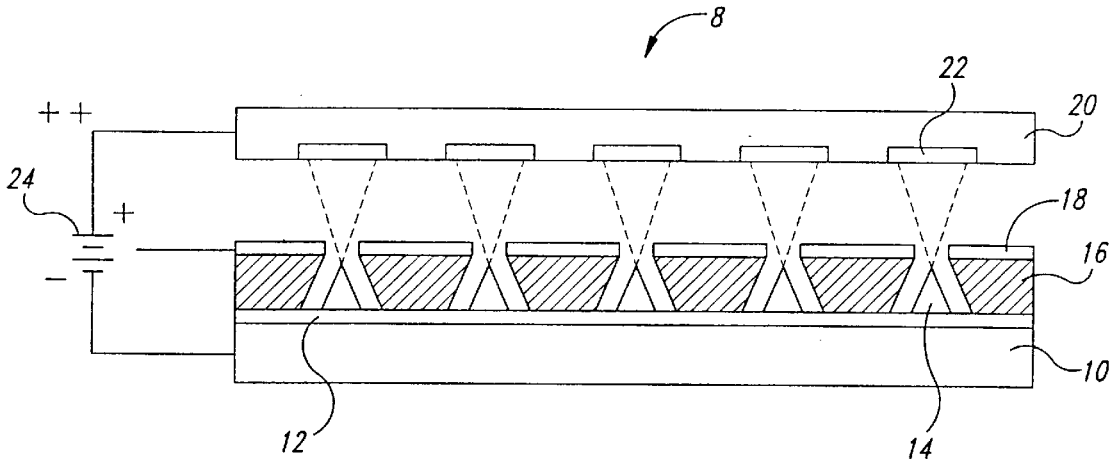
FIG. 1 is a cross-sectional view of a conventional field emission display.
Figure 2:
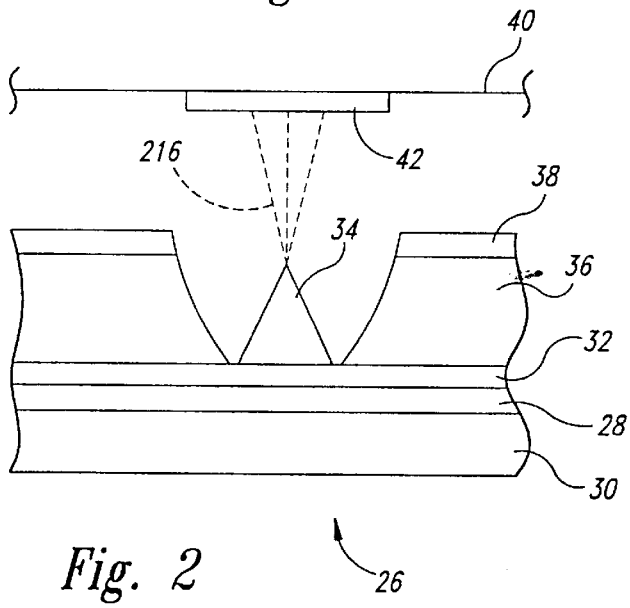
FIG. 2 is a cross-sectional view of a field emission display according to one aspect of the present invention.

FIG. 2 is a cross-sectional view of a portion of a cold-cathode field emission display 26 according to one aspect of the present invention. A conductive layer 28 is formed on a substrate 30. In one aspect of the invention, the conductive layer 28 is a metal layer, and the substrate 30 is formed from silicon. In other aspects of the invention, the substrate 30 may be formed in a conventional manner from a glass such as Corning 7059, from soda lime, or from a plastic. A resistive layer 32 is formed on the conductive layer 28. One or more cold-cathode emitters 34 are formed on the resistive layer 32. For clarity, only one emitter 34 is shown. An insulating layer 36 is also formed on the resistive layer 32, and cavities are formed in the insulating layer 36 to accommodate the emitters 34. A conductive extraction grid 38 is formed on the insulating layer 36. An anode 40, which acts as a display screen, is spaced a predetermined distance from the extraction grid 38 and has a cathodoluminescent coating 42 formed on an inner surface thereof.

In one aspect of the invention, the resistive layer 32 has a level of resistivity which varies less than approximately 10% while exposed to fluctuating optical energy. Typically, the resistive layer 32 provides approximately $1\times10^{6}$–$1\times10^{10}$ ohms (Ω) resistance between the conductive layer 28 and each emitter 34. This range of resistance limits the current passing through each emitter 34 to approximately 1 nano-amp (nA), and limits the total current drawn by the display 26 to approximately 0.1 mA.

In operation, when a voltage difference of approximately 1000 volts (V) is applied between the anode 40 and the substrate 30, and a voltage of approximately 100 V is applied to the extraction grid 38, electrons will flow from the conductive layer 28, through the resistive layer 32, and out from the tips of the emitters 34. The emitted electrons then strike the cathodoluminescent coating 42, which generates visible light or luminance. Some of this light may strike the resistive layer 32. However, in accordance with the invention, the resistivity of the resistive layer 32 will remain relatively stable even while exposed to varying intensities of light from the cathodoluminescent coating 42 or from other sources.

Still referring to FIG. 2, certain materials will provide the stable resistivity desired in the layer 32. In one aspect of the invention, the resistive layer 32 is formed from amorphous silicon that is doped with phosphorous. For example, the layer 32 is typically doped with between approximately 1.0 and 10.0 parts per million (ppm) of phosphorous. Such a layer or film 32 may be formed by conventional semiconductor processes such as glow discharge, thermal, or other deposition processes. For example, the resistive layer 34 may be prepared by a conventional glow discharge using a silane to phosphine ratio of approximately 1% phosphine gas to provide the necessary phosphorus atoms for doping the layer 32. The resistive layer 32 may also be formed from amorphous silicon that is doped with boron, preferably between approximately 10 and 100 ppm of boron. Alternatively, the resistive layer 32 may be formed from amorphous silicon that is doped with nitrogen, preferably between approximately 10.0 and 100.0 ppm nitrogen. The layer 32 may also be formed from either doped or undoped microcrystalline silicon having a preferred grain size of approximately 100 Angstroms (Å) and a preferred orientation of either 100, 110, or 111. The formation of such amorphous and microcrystalline silicon is further discussed in conjunction with FIGS. 5–12.

When formed from one of the above-described materials, the resistive layer 32 exhibits resistivities that are typically in the range of $10^{2}$–$10^{6}$ Ω-cm. Furthermore, the resistivity of such a layer 32 fluctuates very little under various operating conditions of the field emission display 26. For example, the illumination conditions within the field emission display 26 may vary from dark, when the field emission display 26 is not being used, to light, when the cathodoluminescent coating 42 is activated by the electrons emitted from the emitters 34. It is preferred that as the illumination conditions change from dark to light and vice versa, the resistivity of the layer 32 varies by less than 10%. A layer 32 formed from one of the above-described materials meets this criteria.

Figure 3:
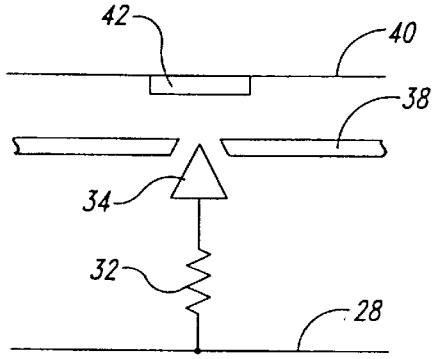
FIG. 3 is a schematic diagram of a portion of the field emission display of FIG. 2.

FIG. 3 is a schematic diagram of the portion of the field emission display 26 that is shown in FIG. 2. In operation, electrons flow from the conductive layer 28, which in one aspect of the invention is a column electrode, to the resistor formed by the resistive layer 32. The electrons then flow from the resistive layer 32 to the emitter 34 and through the vacuum between the extraction grid 38 and the anode 40 until they strike the cathodoluminescent coating 42. Thus, even in the case of a short circuit between the emitter 34 and the extraction grid 38, the resistive layer 32 limits the flow of current, and thus the flow of electrons, through the circuit branch formed by the conductive layer 28, the resistive layer 32, and the emitter 34.

Figure 4:
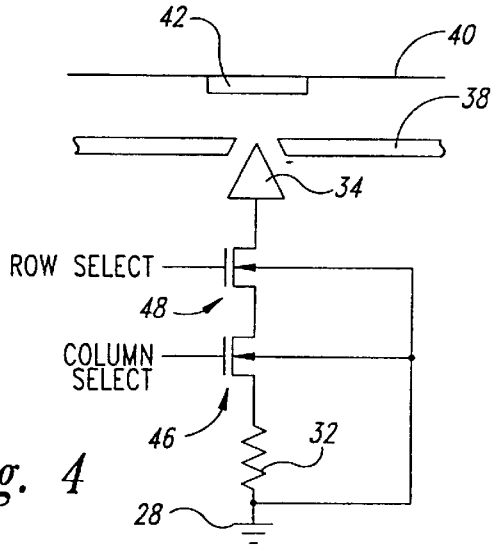
FIG. 4 is a schematic diagram of a portion of a field emission display according to another aspect of the invention.

FIG. 4 is a schematic diagram of another embodiment of the portion of the field emission display 26 that is shown in FIG. 2. A resistor representing the resistive layer 32 is coupled to the conductive layer 28, which here is coupled to ground. A column transistor 46 has its gate coupled to a column-select line, its substrate coupled to ground, and its source coupled to the resistive layer 32. A row select transistor 48 has its gate coupled to a row-select line, its substrate coupled to ground, its source coupled to the drain of the transistor 46, and its drain coupled to the emitter 34.

In operation, when both the row and column that the emitter 34 occupies are selected, both the row-select and the column-select lines are driven with active high row-select and column-select signals respectively, thus causing both transistors 46 and 48 to be activated or "turned on." The activated transistors 46 and 48 allow electrons to flow from the conductive layer 28, through the resistive layer 32, the transistors 46 and 48, and the emitter 34, to the cathodoluminescent coating 42. The resistive layer 32 provides the current-limiting function, as discussed above in conjunction with FIG. 3.

Figure 5:
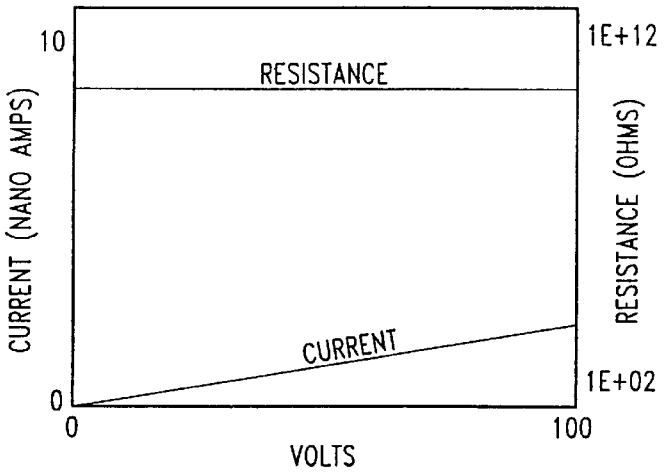
FIG. 5 is a plot of the resistance of and current through a sample of undoped amorphous silicon while exposed to light.

FIG. 5 is a plot showing the resistance of and the current through a sample of undoped amorphous silicon while it is exposed to room lighting conditions. For example, with approximately 100 volts (V) applied across the sample, approximately 2.124 nanoamps (nA) of current flows therethrough, giving a resistance of $46.6\times10^9$ Ω. The resistivity $\rho=Rwt/l$, where R equals the resistance of the sample, w is the width of the sample, t is the thickness of the sample, and l is the length of the sample. For the sample of FIG. 5, w/l=5 and t=0.5 microns (μm). Thus, the resistivity of the sample while exposed to room lighting, i.e., the light resistivity $\rho_L$, is approximately $1.1\times10^7$ Ω-cm.

Figure 6:
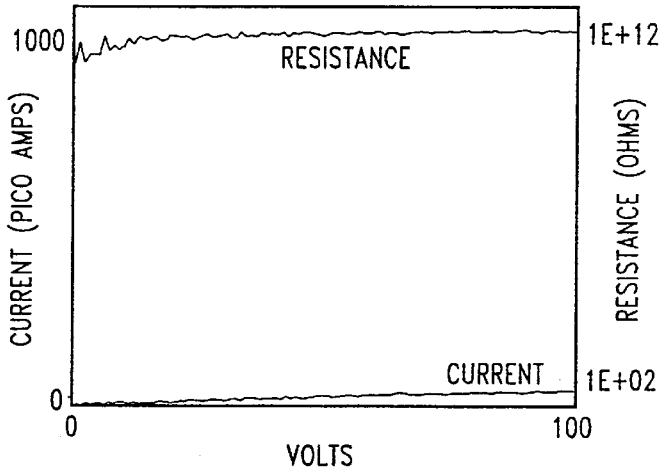
FIG. 6 is a plot of the resistance of and current through the sample of undoped amorphous silicon while unexposed to light.

FIG. 6 is a plot showing the resistance of and the current through the same sample of undoped amorphous silicon while it is unexposed to light, i.e., while in the dark. For example, with 100 V applied across the sample, 49.65 pA of current flows therethrough, giving a resistance of approximately $2.01\times10^{12}$ Ω. Thus, the resistivity of the sample while in the dark, i.e., the dark resistivity $\rho_D$, is approximately $5.02\times10^8$ Ω-cm.

As shown, the difference between $\rho_L$ and $\rho_D$ of the sample of undoped amorphous silicon spans approximately a factor of 50, i.e., 5000%. Such a span often renders undoped amorphous silicon an unacceptable material for the resistive layer 32 of FIG. 2.

The sample of amorphous silicon whose characteristics are plotted in FIGS. 5 and 6 was formed from $SiH_4$ at a flow rate of approximately 800 standard cubic centimeters per minute (SCCM), at a temperature of approximately 300° C., a pressure of approximately 1000 milliTor (mT), and a power of approximately 500 Watts (W) for a time of approximately 5 minutes.

Figure 7:
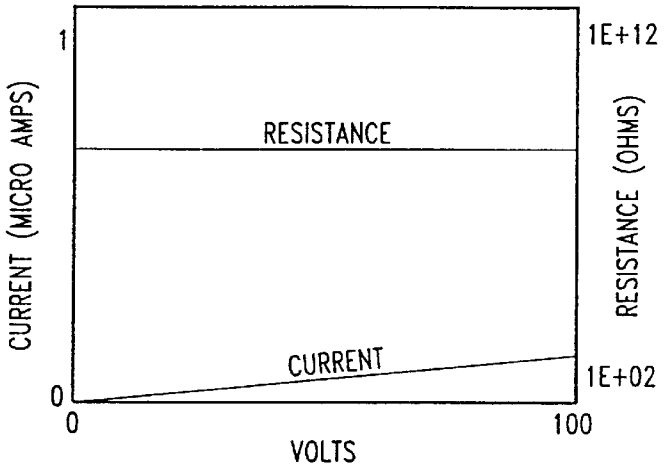
FIG. 7 is a plot of the resistance of and current through a sample of doped amorphous silicon while exposed to light.

FIG. 7 is a plot showing the resistance of and the current through a sample of boron-doped amorphous silicon while it is exposed to room lighting conditions. For example, with approximately 100 V applied across the sample, a current of approximately 116.8 nA flows therethrough, giving a resistance of approximately $847\times10^6$ Ω. For this sample, w\l=5 and t=0.5 μm. Thus, $\rho_L$ is approximately $2.1\times10^5$ Ω-cm.

Figure 8:
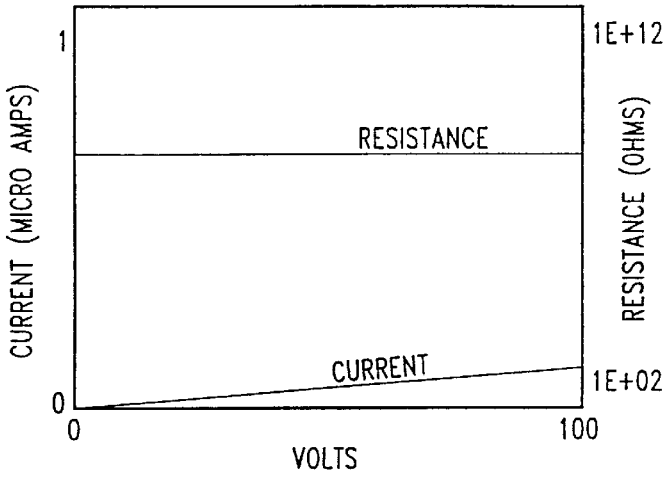
FIG. 8 is a plot of the resistance of and current through the sample of doped amorphous silicon while unexposed to light.

FIG. 8 is a plot showing the resistance of and the current through the same sample while it is in the dark. For example, with approximately 100 V applied across the sample, a current of approximately 108.4 nA flows therethrough, giving a resistance of approximately $913\times10^6$ Ω. Thus, $\rho_D$ is approximately $2.3\times10^5$ Ω-cm.

Referring to FIGS. 7 and 8, unlike the light and dark resistivities of the sample of undoped amorphous silicon, $\rho_D$ and $\rho_L$ for the sample of boron-doped amorphous silicon differ by merely 8%–10%. Thus, the doping with boron of the amorphous silicon significantly improves the stability of its resistivity with respect to variations in illumination. Furthermore, the doping of the amorphous silicon reduces the overall resistivity of the sample. Thus, boron-doped amorphous silicon is a suitable material for the resistive layer 32 of FIG. 2.

The sample of boron-doped amorphous silicon, whose characteristics are plotted in FIGS. 7 and 8, was formed from $SiH_4$ at a flow rate of approximately 500 SCCM, a temperature of approximately 300° C., a power of approximately 500 W, and a pressure of approximately 1000 mT for a time of approximately 5 minutes. The formed sample has a boron concentration of approximately 10 ppm.

An improvement in the stability of the resistivity of amorphous silicon may also be made by doping the amorphous silicon with phosphorous, arsenic, or ammonia. Like the boron doping discussed above, such doping reduces both the resistivity of the amorphous silicon and the resistivity's sensitivity to light. Thus, by selecting the proper dopant and doping concentration, one can adjust the resistivity and its light sensitivity to the desired levels. It is also important to note, however, that excessive concentrations of dopant (beyond approximately 10% for boron, 1% for phosphorous, 1% for arsenic, and 10% for ammonia) may actually increase both the resistivity of the amorphous silicon and the light sensitivity of the resistivity.

Figure 9:
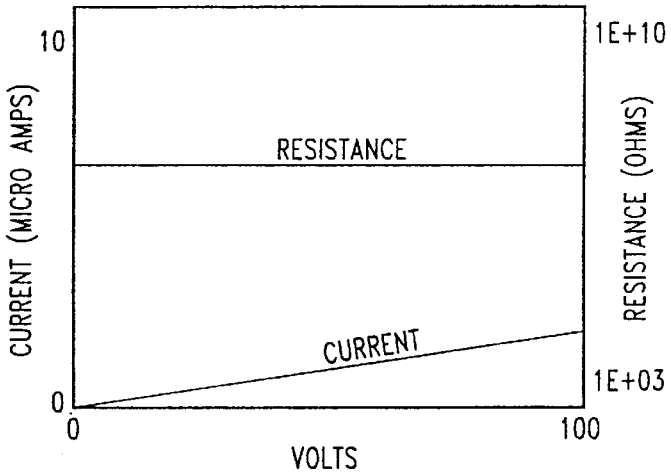
FIG. 9 is a plot of the resistance of and current through a first sample of doped microcrystalline silicon while exposed to light.

FIG. 9 is a plot showing the resistance of and the current through a sample of boron-doped microcrystalline silicon while exposed to room light. For example, with approximately 100 V applied across the sample, a current of approximately 2.09 microamps (μA) flows therethrough, giving a resistance of approximately $47.7\times10^6$ Ω. For this sample, w\l=5 and t=0.5 μm. Thus, $\rho_L$ is approximately $1.2\times10^4$ Ω-cm.

Figure 10:
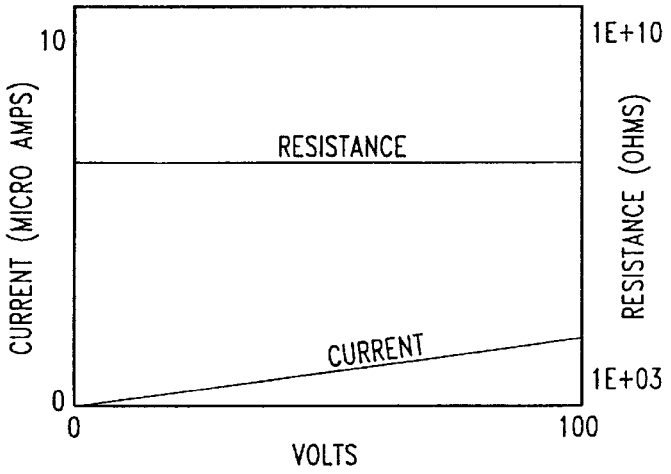
FIG. 10 is a plot of the resistance of and current through the first sample of doped microcrystalline silicon while unexposed to light.

FIG. 10 is a plot showing the resistance of and the current through the sample while in the dark. For example, with approximately 100 V applied across the sample, a current of approximately 1.919 μA flows therethrough, giving a resistance of approximately $52.1\times10^6$ Ω. Thus, $\rho_D$ is approximately $1.3\times10^4$ Ω-cm.

Figure 11:
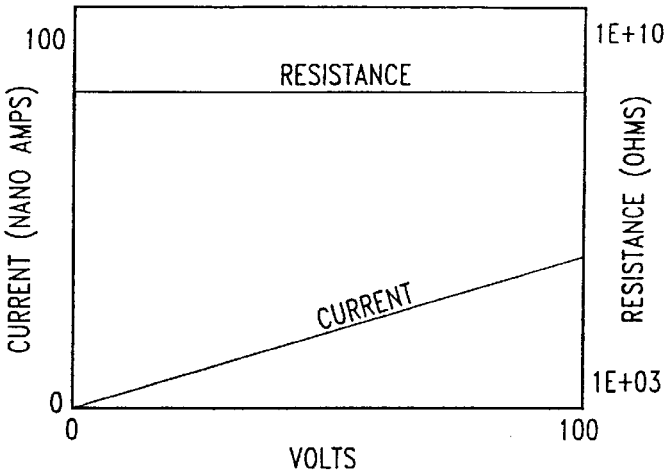
FIG. 11 is a plot of the resistance of and current through a second sample of undoped microcrystalline silicon while exposed to light.

FIG. 11 is a plot of the resistance of and the current through a sample of undoped microcrystalline silicon while exposed to room light. For example, with approximately 100 V applied across the second sample, a current of approximately 43.16 nA flows therethrough, giving a resistance of approximately $2.32\times10^9$ Ω. For this sample, w\l=5 and t=0.5 μm. Thus, $\rho_L$ is approximately $5.8\times10^5$ Ω-cm.

Figure 12:
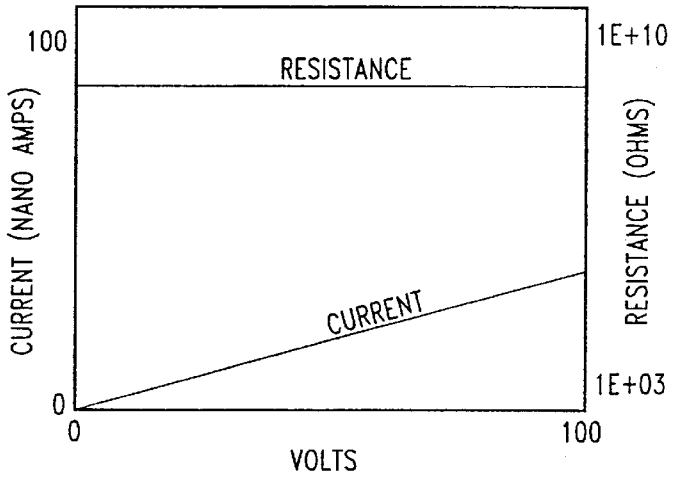
FIG. 12 is a plot of the resistance of and current through the second sample of undoped microcrystalline silicon while unexposed to light.

FIG. 12 is a plot of the resistance of and the current through the sample while in the dark. For example, with approximately 100 V applied across the sample, a current of approximately 39.5 nA flows therethrough, giving a resistance of $2.53\times10^9$ Ω. Thus, $\rho_D$ is approximately $6.3\times10^5$ Ω-cm.

Referring to FIGS. 9 and 10, the $\rho_L$ and $\rho_D$ of the boron-doped microcrystalline sample respectively differ by approximately 8%–10%. Referring to FIGS. 11 and 12, the $\rho_L$ and $\rho_D$ of the undoped microcrystalline sample also differ by approximately 8%–10%. Thus, one can see that the resistivity of microcrystalline silicon, whether doped or undoped, exhibits excellent insensitivity to light. That is, the resistivity of microcrystalline silicon is essentially insensitive to variations in illumination.

The sample of boron-doped microcrystalline silicon, the characteristics of which are plotted in FIGS. 9 and 10, was formed from $SiH_4$ at a flow rate of approximately 100 SCCM, $H_2$ at a flow rate of approximately 3000 SCCM, $B_2H_6$ at a flow rate of approximately 10 SCCM, at a temperature of approximately 300° C., a power of approximately 700 W, and a pressure of approximately 1000 mT for a time of approximately 40 minutes. The formed sample has a boron concentration of approximately 1 ppm.

The sample of undoped microcrystalline silicon, whose characteristics are plotted in FIGS. 11 and 12, was formed from $SiH_4$ at a flow rate of approximately 100 SCCM, $H_2$ at a flow rate of approximately 3000 SCCM, at a temperature of approximately 300° C., a power of approximately 1500 W, and a pressure of approximately 850 mT for a time of approximately 40 minutes.

N-type microcrystalline silicon may be formed by adding to the above chemistry phosphine or arsine flowing at up to 1% of the amount of the saline, i.e., 1 SCCM.

The more dopant added to the microcrystalline silicon, the lower the resistivity of the sample. Unlike amorphous silicon, dopants have little effect on the light stability of the resistivity of the microcrystalline silicon. That is, the excellent light stability of the resistivity is due to the microcrystalline silicon itself, and the dopants merely adjust the desired value of the resistivity. As stated above with regard to amorphous silicon, dopants in excess of the amounts specified may increase the resistivity of microcrystalline silicon and degrade the light stability of the microcrystalline silicon's resistivity.

Figure 13:
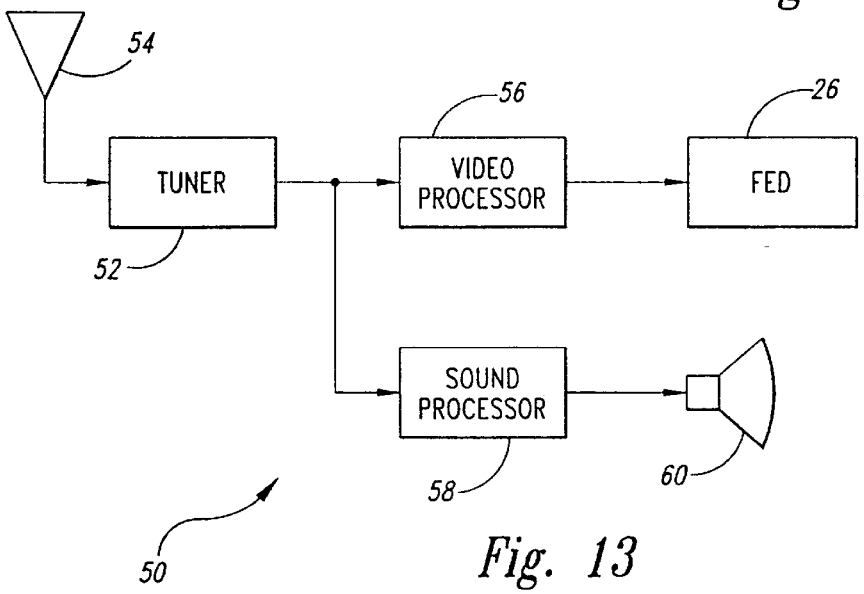
FIG. 13 is a block diagram of a video receiver and display device that incorporates the present invention.

FIG. 13 is a block diagram of a video receiver and display device 50 that incorporates the present invention. The circuit device 50 includes a conventional tuner 52, which receives one or more broadcast video signals from a conventional signal source such as an antenna 54. An operator (not shown) programs, or otherwise controls, the tuner 52 to select one of these broadcast signals and to output the selected broadcast signal as a video signal. The tuner 52 may generate the video signal at the same carrier frequency as the selected broadcast signal, at a base band frequency, or at an intermediate frequency, depending upon the design of the device 50.

The tuner 52 couples the video signal to a conventional video processor 56 and to a conventional sound processor 58. The sound processor 58 decodes the sound component of the video signal and provides this sound signal to a speaker 60, which converts the sound signal into audible tones. The video processor 56 decodes, or otherwise processes, the video component of the video signal, and generates a display signal from this video component. The video processor 56 may generate the display signal as either a digital or an analog signal, depending upon the design of the device 50. The video processor 56 couples the display signal to the FED 26 (FIG. 2), which converts the display signal into a visible video image.

In one aspect of the invention, the sound processor 58 and the speaker 60 are omitted such that the device 50 provides only a video image. Furthermore, although shown coupled to the antenna 54, the tuner 52 may receive broadcast signals from other conventional sources, such as a cable system, a satellite system, or a video cassette recorder (VCR). Alternatively, the tuner 52 may receive a non-broadcast video signal, such as from a closed circuit video system (not shown). In such a case where only one video signal is input to the circuit 50, the tuner 52 may be omitted and the video signal may be directly coupled to the inputs of the video processor 56 and the sound processor 58.

It will be appreciated that, although specific embodiments of the invention have been described herein for purposes of illustration, various modifications may be made without departing from the spirit and scope of the invention. Accordingly, the invention is not limited except as by the appended claims.

What is claimed is:

1. A method for forming a semiconductor structure, comprising:

forming on a substrate a conductive layer;

forming on said conductive layer a resistive layer including microcrystalline silicon, the resistive layer having a light resistivity while exposed to optical energy and having a dark resistivity while substantially unexposed to optical energy, said light resistivity differing from said dark resistivity by less than approximately 10%, including doping the resistive layer with between approximately 10 ppm and about 100 ppm boron; and forming on said resistive layer at least one cold-cathode emitter.

2. The method of claim 1 wherein doping the resistive layer comprises doping said resistive layer with a P-type impurity.

3. The method of claim 1 wherein doping the resistive layer comprises doping said resistive layer with an N-type impurity.

4. A method for forming a semiconductor structure, comprising:

forming on a substrate a conductive layer;

forming on said conductive layer a resistive layer including microcrystalline silicon, the resistive layer having a light resistivity while exposed to optical energy and having a dark resistivity while substantially unexposed to optical energy, said light resistivity differing from said dark resistivity by less than approximately 10%, including doping the resistive layer with between approximately 1 ppm and about 10 ppm phosphorous; and forming on said resistive layer at least one cold-cathode emitter.

5. The method of claim 4 wherein doping the resistive layer comprises doping said resistive layer with an N-type impurity.

6. The method of claim 4 wherein doping the resistive layer comprises doping said resistive layer with a P-type impurity.

7. A method for forming a semiconductor structure, comprising:

forming on a substrate a conductive layer;

forming on said conductive layer a resistive layer including microcrystalline silicon, the resistive layer having a light resistivity while exposed to optical energy and having a dark resistivity while substantially unexposed to optical energy, said light resistivity differing from said dark resistivity by less than approximately 10%, including doping the resistive layer with between approximately 1 ppm and about 10 ppm arsenic; and forming on said resistive layer at least one cold-cathode emitter.

8. The method of claim 7 wherein doping the resistive layer comprises doping said resistive layer with a P-type impurity.

9. The method of claim 7 wherein doping the resistive layer comprises doping said resistive layer with an N-type impurity.

10. A method for forming a semiconductor structure, comprising:

forming on a substrate a conductive layer;

forming on said conductive layer a resistive layer including microcrystalline silicon, the resistive layer having a light resistivity while exposed to optical energy and having a dark resistivity while substantially unexposed to optical energy, said light resistivity differing from said dark resistivity by less than approximately 10%; and forming on said resistive layer at least one cold-cathode emitter.

11. The method of claim 10, further comprising doping said resistive layer with an impurity.

12. The method of claim 10, further comprising doping said resistive layer with a P-type impurity.

13. The method of claim 10, further comprising doping said resistive layer with an N-type impurity.

* * * * *